US005659923A

United States Patent [19]

Coombs

[11] Patent Number: 5,659,923

[45] Date of Patent: Aug. 26, 1997

[54] VACCUM CLEANER FLOOR TOOL

[75] Inventor: Richard L. Coombs, Boise, Id.

[73] Assignee: Pro-Team, Inc., Boise, Id.

[21] Appl. No.: 631,636

[22] Filed: Apr. 8, 1996

[51] Int. Cl.[6] ..... A47L 9/06

[52] U.S. Cl. ..... 15/398; 15/420

[58] Field of Search ..... 15/398, 420, 421

[56] References Cited

U.S. PATENT DOCUMENTS

| | | | |
|---|---|---|---|
| 1,992,238 | 2/1935 | Rose | 15/420 |
| 3,550,183 | 12/1970 | Wolf | 15/420 X |
| 4,677,705 | 7/1987 | Schuster | 15/420 X |
| 5,101,534 | 4/1992 | Watanabe et al. | 15/420 X |

FOREIGN PATENT DOCUMENTS

| | | | |
|---|---|---|---|
| 743683 | 1/1933 | France | 15/420 |
| 113431 | 8/1968 | Norway | 15/420 |
| 597752 | 2/1948 | United Kingdom | 15/420 |

*Primary Examiner*—Chris K. Moore

*Attorney, Agent, or Firm*—Frank J. Dykas

[57] ABSTRACT

A vacuum cleaner floor tool is provided with a vacuum chamber housing top cover, and parallel front and rear floor engagement bars. Floor engagement bars are provided with a plurality of air bypass slots extending up from a floor engaging bottom surface of the front and rear bars. Said bypass slots together have a total cumulative cross-sectional area within the range of 85% to 115% of the cross-sectional area of a top cover orifice. The top cover orifice is interconnected to a wand-receiving socket. A brush is provided attached to the rear beater bar.

2 Claims, 4 Drawing Sheets

VACCUM CLEANER FLOOR TOOL

BACKGROUND OF THE INVENTION

1. Technical Field

This invention generally relates to a vacuum cleaner floor tool, and more particularly to a vacuum cleaner floor tool for use with deep-pile carpet.

2. Background

In the prior art today there is no suitable vacuum cleaner floor tool for use with high-capacity vacuum cleaners to clean deep-pile carpets, except those vacuum cleaners which feature electrically powered rotating beater bars which are used to agitate and brush the carpet fibers to dislodge particles of dust and dirt found at the bottom of the carpet between the carpet webbing and the attached fibers. There is a reason for this. High capacity vacuum cleaners, particularly those used in industrial applications, for example, those used by janitorial services cleaning office buildings, often provide section heads enabling air flows of 100 cubic feet per minute and higher. In other words, they provide a lot of suction. The typical non-beater bar or stationary floor tool, is not suitable for use with these types of vacuum cleaners for deep pile carpets. The reason is that the high suction air flow rates draw the floor tool down into the deep pile to the extent that the raking bars found on the front and rear periphery of the tool pneumatically sealed off the floor tool, such that the floor tool is literally sucked into the carpet. In this condition they are difficult to push across the carpet.

This is one of the reasons why the electrically powered rotating beater bar designs have been so popular. With these prior art designs, the suction head for the vacuum pump is not applied directly to the pile of the carpet, but instead is positioned and held above the carpet by the chassis or frame of the beater bar. Often times these electrically powered beater bar tools are provided with wheels so that the suction head stays above the top of the carpet, with the brushes on the beater bar brushing through the carpet to dislodge and hopefully bring up the dirt and dust which are normally found at the bottom of the carpet pile next to the carpet mat to which the pile is attached.

The rotating brushes found on electrically powered rotating beater bar floor tools are also very hard on the carpet. Each time the brushes are forced through the carpet pile, they break bonds between the carpet pile and the carpet mat and break off and dislodge fibers of the carpet, which are then later sucked into the vacuum cleaner. While this may not be a significant factor in low-traffic residential uses, for example a formal living room in a residential home, it is significant in high-traffic commercial areas where carpets are vacuumed frequently, perhaps even daily.

The facts that conventional vacuum cleaner floor tools will be sucked into deep-pile carpet, thereby sealing off the vacuum and making them very difficult to push around, and the damage done to deep-pile carpets by rotating beater bar brushes, are primary reasons why deep-pile carpets are not found in high-traffic commercial use buildings. Deep-pile carpets have been, in the prior art, simply too difficult to keep clean with conventional vacuum cleaner floor tools, and wear out too quickly if beater bar vacuum cleaners are used regularly to clean them.

Accordingly, it is an object of the present invention to provide a vacuum cleaner floor tool of a type that does not utilize rotating beater bar brushes, but instead simply applies vacuum and mild agitation of the carpet pile to clean the carpet. It is a further object of this invention to provide a vacuum cleaner floor tool which is not drawn into the carpet, thereby forming a pneumatic seal and thereby increasing the force required to push it back and forth across the carpet.

DISCLOSURE OF INVENTION

A floor tool is formed of a vacuum chamber housing, which includes a top cover, a front bar and a rear bar. The front bar and rear bar are attached to the top cover, and form between them a vacuum chamber, which is operatively connected to an orifice and a wand receiver. The wand receiver is sized for interconnection with a hand wand of a vacuum cleaner.

Front and rear glide rakes are formed integral with front and rear bars respectively. Front and rear glide rakes are formed with curved surfaces for easy gliding across deep pile or short pile carpet and even hard surfaces.

The wand receiver assembly includes an integrally formed snap ring which interfits Within a circular detent formed integrally with a swivel receiver extension formed around the orifice. The vacuum cleaner floor tool is provided with a plurality of bypass holes formed integral with the front and rear bars and glide rakes. The holes are generally evenly spaced out along the front and rear bars. Additional bypass holes are provided on each side of the vacuum cleaner floor tool. The bypass holes are sized such that the largest holes, permitting the greatest flow of air to enter the vacuum chamber, are formed at the ends as end bypass holes. The next largest bypass holes are those found at the ends of the front and rear bars. The remaining bypass holes are sequentially smaller, with the smallest being the center line bypass holes in the front and rear bars. The sequential sizing is provided to better equalize perimeter air flow throughout the vacuum chamber. The bypass holes are sized such that they cumulatively total a cross sectional area which is approximately equal to the cross-sectional area of the orifice opening. Or, at least within the range of plus or minus fifteen (15%) per cent of the orifice opening size.

In operation, when a vacuum pump attached through a hand wand to the vacuum cleaner floor tool draws air through the vacuum chamber, the air flow through the bypass holes will be sufficient to prevent the vacuum cleaner floor tool from being sucked down into the carpet, actually being pushed down by air pressure, and so that the vacuum cleaner floor tool can be moved across the carpet without excessive effort.

A carpet brush is attached within the vacuum cleaner to the rear bar and positioned such that it gently agitates the top surfaces of the carpet to system dislodging dirt and dust.

BEST MODE FOR CARRYING OUT INVENTION

Figure 2:
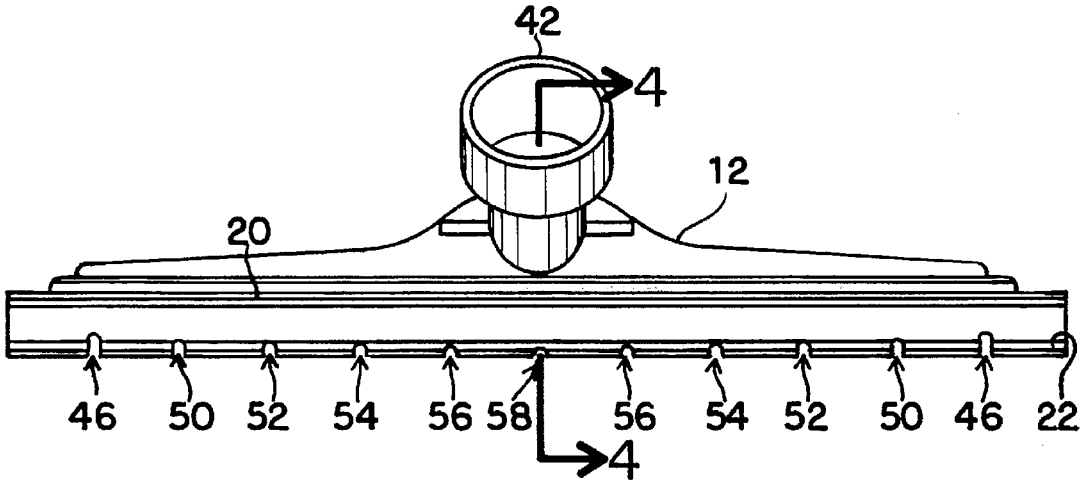
FIG. 2 is a back view showing the orifice in the top cover of the vacuum cleaner floor tool.
Figure 3:
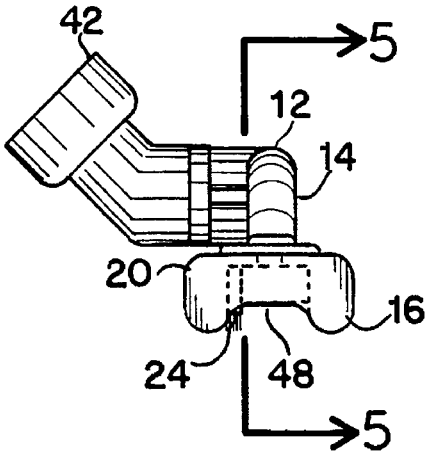
FIG. 3 is a side plan view of a vacuum cleaner floor tool.
Figure 4:
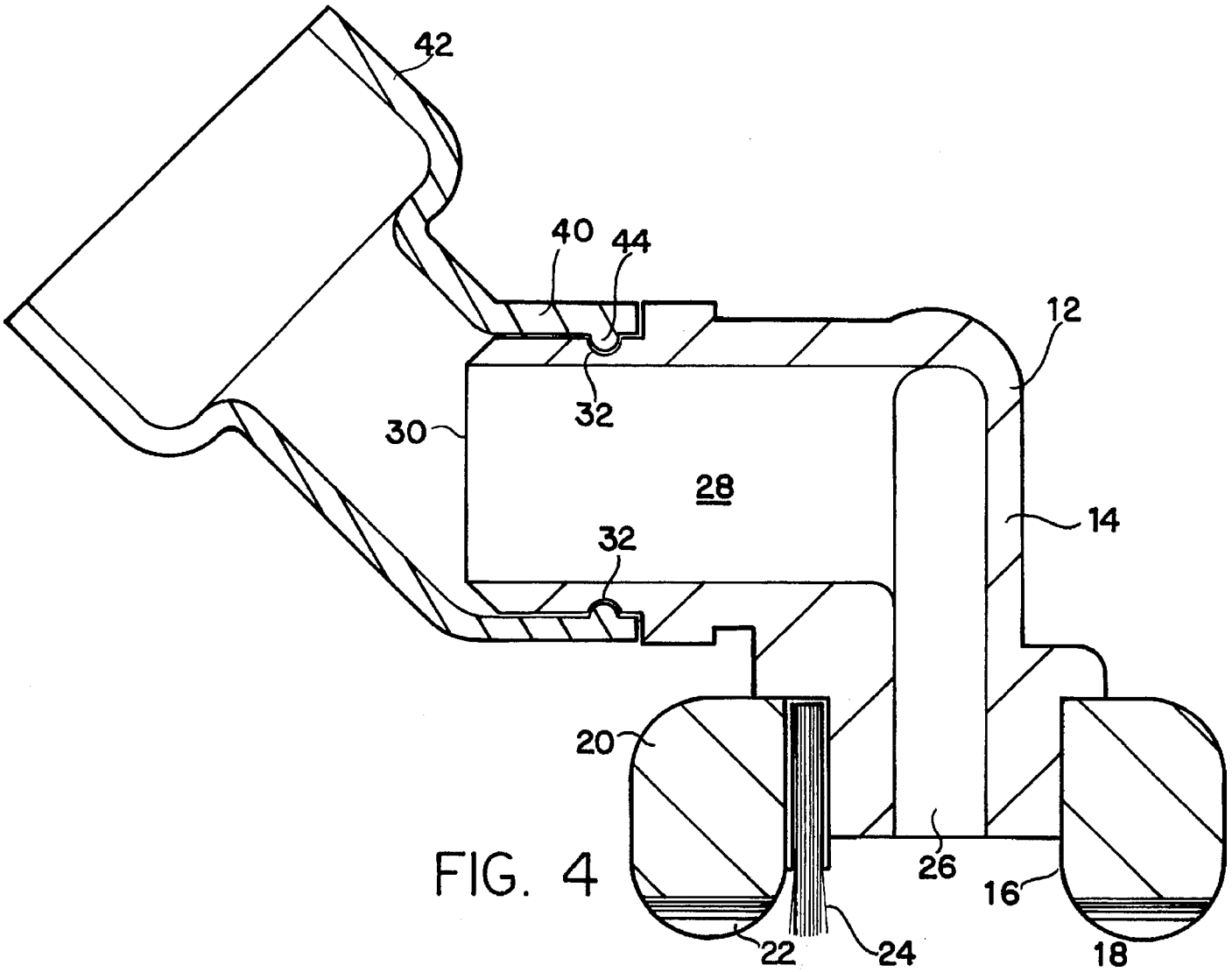
FIG. 4 is a sectional representational side view taken along the plane 4—4 of FIG. 2.
Figure 5:
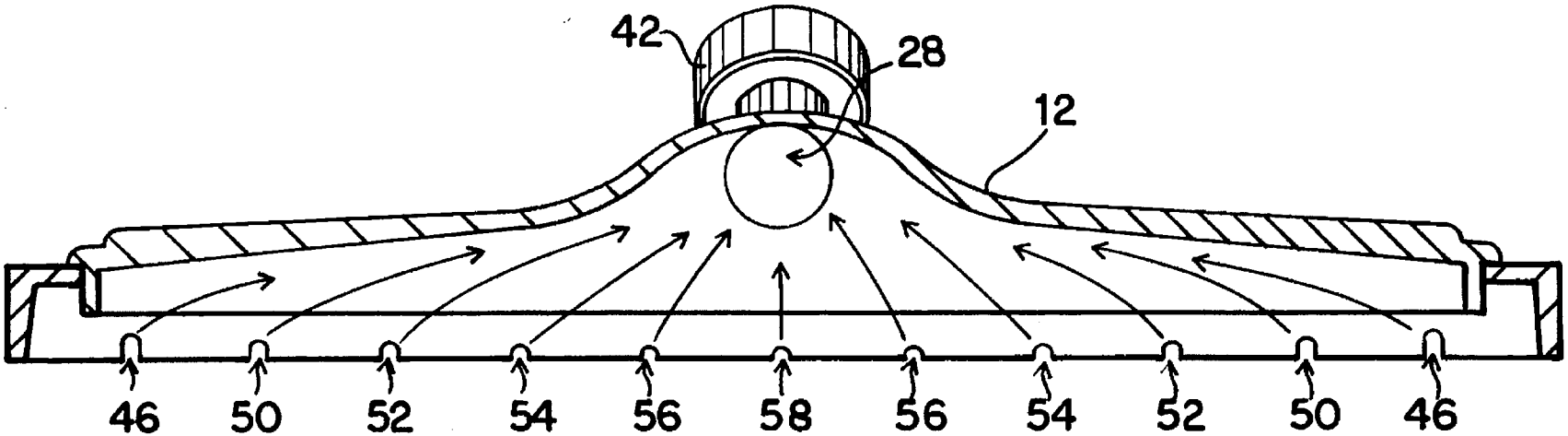
FIG. 5 is a sectional representational side view of the vacuum cleaner floor tool taken along the plane 5—5 of FIG. 2, with the carpet brush removed.

Referring to FIGS. 1 through 5, there is shown the preferred embodiment of the vacuum cleaner floor tool. As shown in FIG. 4, which is a sectional representational view of vacuum cleaner floor tool 10, there is formed a vacuum chamber housing 12 formed from top cover 14 and front bar 16 and rear bar 20. Front bar 16 and rear bar 20 are attached to top cover 12 and between them form vacuum chamber 26.

Vacuum chamber 26 is operatively connected through orifice 28 and wand receiver assembly 40 to wand receiver 42. Wand receiver 42 is sized for interconnection with a hand wand, not shown, operatively attached to a vacuum pump.

In the preferred embodiment, front glide rake 18 is formed integrally with front bar 16 and forms a curved surface designed for easy gliding across deep-pile carpet, short-pile carpet, and even hard surface floors, such as hardwood or linoleum. In the preferred embodiment, front and rear bars 16 and 20 and front and rear glide rakes 18 and 22 are formed of a Teflon®-coated material so as not to scratch or mar hard surfaces. The wand receiver assembly includes integrally formed snap ring 44 which interfits within detent 32 formed integrally with swivel receiver extension 30 formed around orifice 28. In this configuration, glide rakes 18 and 22 of vacuum cleaner hand tool 10 ride horizontally across the floor, even though the vacuum cleaner hand wand, not shown, interfitting into wand receiver 42 is elevated in a convenient position for operator use.

In the preferred embodiment, the vacuum cleaner floor tool 10 is configured with a one and one-half inch orifice 28, which is a standard size for high-capacity vacuum cleaners having vacuum pumps capable of drawing a vacuum head sufficient to produce air flows in excess of 100 cubic feet per second. The one and one-half inch size for orifice 28 provides for a 1.76 square inch cross-sectional area.

Vacuum chamber 26 is, because of the extended lateral length of front and rear bars 16 and 20, a considerably larger cross-sectional area than orifice 28. The exact lateral length of front and rear bars 16 and 20 is not a particularly critical dimension, but in the preferred embodiment is between ten and fourteen inches in length. It can be larger or smaller.

Figure 1:
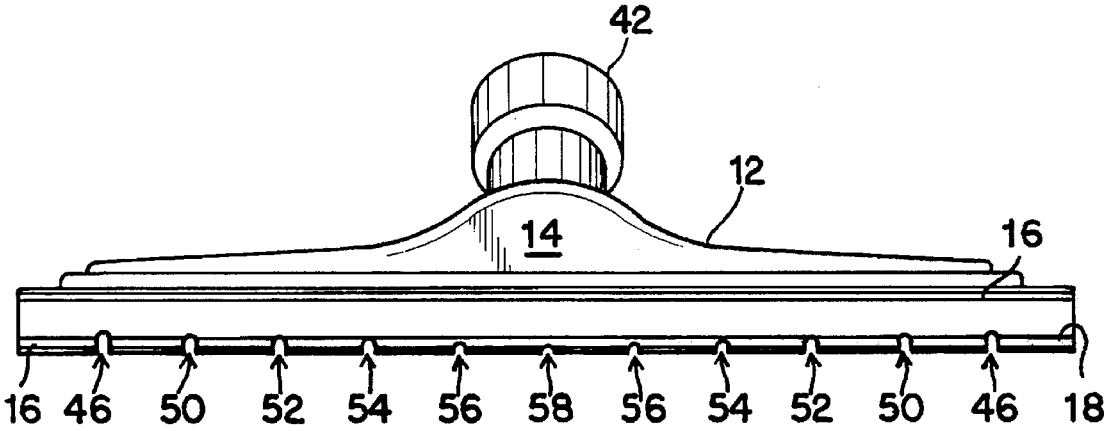
FIG. 1 is a front plan view of the vacuum cleaner floor tool.

However, the cross-sectional area of the bypass holes as herein described is of significance to the design of vacuum cleaner floor tool 10. Vacuum cleaner floor tool 10 is provided with a plurality of bypass holes formed integral with the front and rear bars 16 and 20 and glide rakes 18 and 24. As shown in FIGS. 1 and 2, the bypass holes are generally evenly spaced out along the front and rear bars. An additional bypass hole 48 is provided at each end of floor tool 10, as shown in FIG. 3. These bypass holes are sized such that the largest holes, permitting the greatest flow of air to enter vacuum chamber 26, are provided at the ends as end bypass holes 48 as shown in FIG. 3. The next largest bypass holes are those found at the ends of the front and rear bars and are shown as 46 in FIGS. 1 and 2. The fourth, third, second and first lateral bypass holes shown as 50, 52, 54 and 56 in FIGS. 1 and 2 are each sequentially smaller in size, the smallest bypass holes are the center line bypass holes 58. The purpose of this sequential sizing is to better equalize perimeter air flow throughout vacuum chamber 26. They are sized such that they cumulatively total a cross-sectional area which is approximate equal to the 1.76 square inch cross-sectional area of orifice 28. In practice, it has been found that the vacuum cleaner floor tool 10 works adequately with deep-pile carpet if the cumulative cross-sectional area of the bypass holes is within a range of plus or minus fifteen per cent (15%) of the cross-sectional area of the discharge orifice 28.

In operation, when the vacuum pump is activated, it draws air through the vacuum chamber 26. If there is a mis-match between the cumulative cross-sectional areas of the bypass holes and orifice 28 such that the bypass holes cannot pass an amount of air equal to that flowing through orifice 28, then a vacuum is drawn in vacuum cleaner floor tool 10, and the tool will be sucked down into the carpet. With the cross-sectional area of the bypass holes and the orifice 28 closely matched, the vacuum is not as great, and in practice has been found to be within a range of between five to ten pounds, and as such the vacuum cleaner floor tool 10 can be easily pushed across the carpet. As it is pushed across the carpet, carpet brush 24, which is attached to vacuum chamber housing 12, brushes partially into the pile, but not all the way down to the carpet mat, thereby providing some agitation with minimal damages to the carpet. Particles of dirt and dust are dislodged from the carpet by the air flow created by the vacuum pump, are sucked out through orifice 28. The variable sizing of the bypass, and the resulting, more equalized air flow, results in more uniform cleaning action across the length of the floor tool.

Carpet brush 24 is not essential to the operation of vacuum cleaner floor tool 10, however it does improve cleaning performance to a limited degree without unduly increasing the wear factors as previously described in the prior art section caused by a rotating beater brush.

As previously stated, the sequential sizing of the bypass holes provides for a more uniform air flow through vacuum cleaner floor tool 10. If they were of a uniform size around the entire perimeter of vacuum cleaner floor tool 10, then cleaning ability at the outer extremities of the floor tool is reduced as a result of reduced air flow in those regions.

Figure 6:
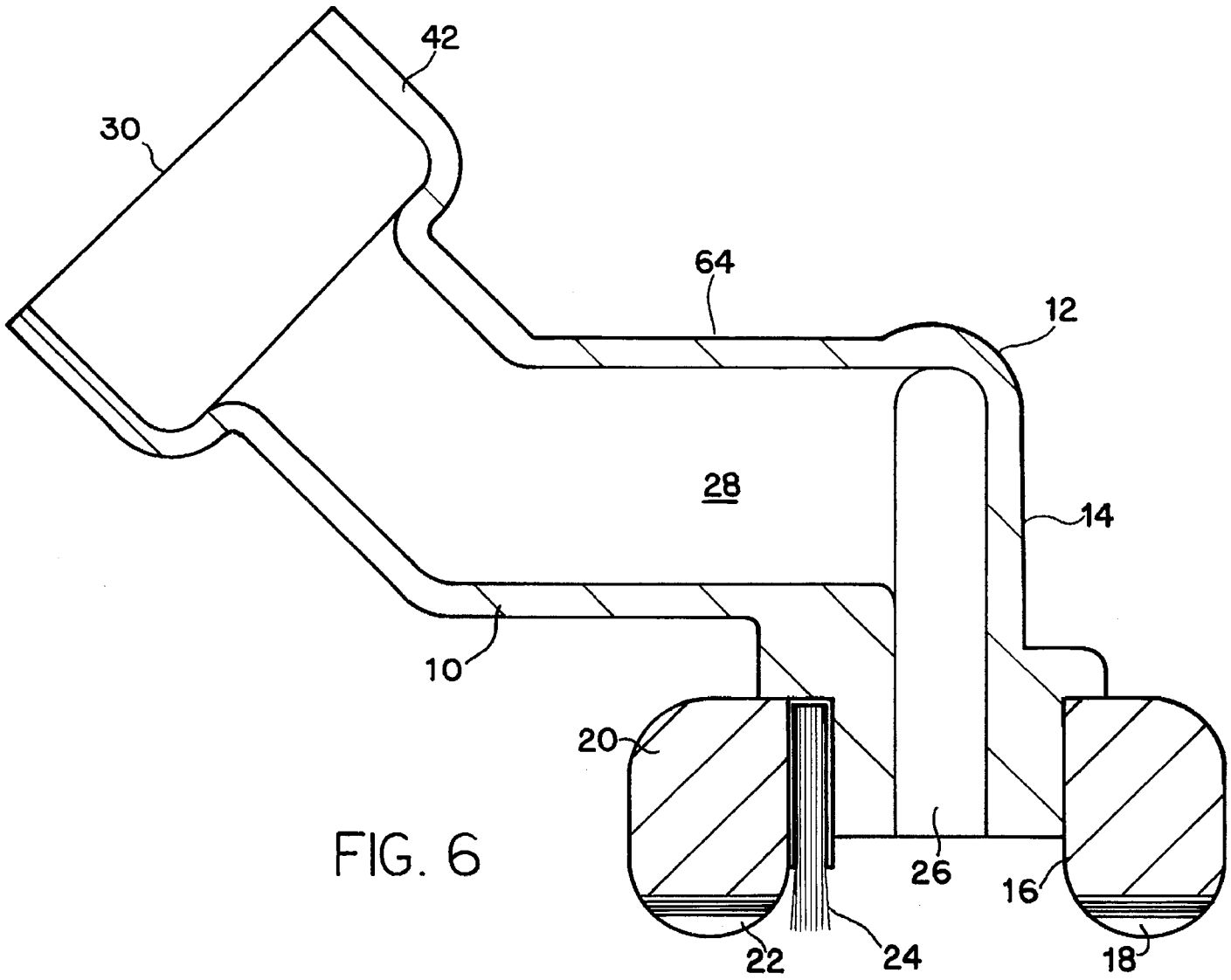
FIG. 6 is a sectional side view of the vacuum cleaner floor tool in a second embodiment showing a unitary top cover and wand receiver taken along the plane 4—4 of FIG. 2.

FIG. 6 discloses a second preferred embodiment of vacuum cleaner floor tool 10, which features unitary body 64 for interconnection with the hand wand of the vacuum cleaner.

While there is shown and described the present preferred embodiment of the invention, it is to be distinctly understood that this invention is not limited thereto but may be variously embodied to practice within the scope of the following claims.

I claim:

1. A vacuum cleaner floor tool for use with a vacuum pump which comprises:

a vacuum chamber housing having a top cover portion, a front bar, and a rear bar, said bars both attached to the top cover portion in juxtaposed spaced relationship and forming there between a vacuum chamber which is open at the bottom parallel to a lateral axis formed between the juxtaposed bars, said top cover portion further having an orifice of predetermined cross sectional area therein for operable interconnection with the vacuum pump, said front and rear bars each having a floor engaging bottom surface, said bars each having formed therein a plurality of air bypass slots extending up from the floor engaging bottom surface, said bypass slots together having a total cumulative cross sectional area within the range of eighty five percent to one hundred fifteen percent of the cross sectional area of the top cover portion orifice, said front and rear bar bypass slots being individually sized to maintain generally uniform air flow across the open bottom of said vacuum chamber.

2. The vacuum cleaner floor tool of claim 1 which further comprises a floor brush interfitted between the juxtaposed bars parallel to the lateral axis and attached to said vacuum cleaner floor tool in a position to brush a floor.

* * * * *